US005634631A

United States Patent [19]

Rodi

[11] Patent Number: 5,634,631

[45] Date of Patent: Jun. 3, 1997

[54] SHEET DELIVERY IN A PRINTING PRESS

[75] Inventor: Anton Rodi, Leimen, Germany

[73] Assignee: Heidelberger Druckmaschinen AG, Heidelberg, Germany

[21] Appl. No.: 432,775

[22] Filed: May 2, 1995

[30] Foreign Application Priority Data

May 3, 1994 [DE] Germany ..... 44 15 485.2

[51] Int. Cl.[6] ..... B65H 39/02

[52] U.S. Cl. ..... 270/58.08; 414/904; 156/212; 156/486

[58] Field of Search ..... 270/52.18, 58.08; 414/904; 156/512, 558, 578, 216, 212, 486, 489

[56] References Cited

U.S. PATENT DOCUMENTS

| | | | |
|---|---|---|---|
| 3,535,189 | 10/1970 | Hall et al. | 156/486 |
| 4,077,831 | 3/1978 | Snellman et al. | 156/578 X |
| 4,473,425 | 9/1984 | Baughman et al. | 156/578 X |
| 4,715,925 | 12/1987 | Hofmeister et al. | 414/904 X |
| 4,889,581 | 12/1989 | Ulrich et al. . | |
| 4,962,704 | 10/1990 | Actor | 101/142 |
| 5,159,798 | 11/1992 | Hannon . | |
| 5,227,002 | 7/1993 | Faust et al. . | |
| 5,395,466 | 3/1995 | Tukagoshi et al. | 156/212 |

FOREIGN PATENT DOCUMENTS

| | | |
|---|---|---|
| 1933569 | 7/1964 | Germany . |
| 1934549 | 6/1965 | Germany . |
| 7608645 | 7/1976 | Germany . |
| 3236702 | 2/1984 | Germany . |
| 8803375 | 8/1988 | Germany . |
| 3837817 | 5/1990 | Germany . |

*Primary Examiner*—Hoang Nguyen

*Attorney, Agent, or Firm*—Herbert L. Lerner; Laurence A. Greenberg

[57] ABSTRACT

Sheet delivery device in a printing press having stops and sheet pushers or sliders for forming a sheet pile on a changeable sheet-pile carrier, and a conveyor system for transporting sheets successively to a location above the sheet pile includes a stabilizing device actuatable, upon the occurrence of a pile change, for stabilizing the sheets forming the sheet pile, the stabilizing device forming a releasable adhesive connection of sheet edges at least at one side of the pile and in an upper region of the pile.

10 Claims, 4 Drawing Sheets

26
27
21
24
23
6.3
1
25
22

26
27
21
1
24
23
6.3
25
22

26
27
21
24
23
6.3
25
1
22

26
21
1
27
6.3
24
23
25
22

SHEET DELIVERY IN A PRINTING PRESS

BACKGROUND OF THE INVENTION

Field of the Invention

The invention relates to a sheet delivery device in a printing press and, more particularly, to such a sheet delivery device having stops and sheet pushers or sliders for forming a sheet pile on a changeable sheet-pile carrier, and a conveyor system for transporting sheets successively to a location above the sheet pile.

When a pile of printed sheets is transported from a delivery of a printing press to a location at which the sheets are to be processed further, the problem arises that the upper sheets in the sheet pile tend to slip out of place and, consequently, smear unnoticeably, thereby necessitating a realignment of the sheets in the sheet pile prior to making them accessible to automatic separator or singling devices of the press for further processing. Automation in printing press construction and the realization of a fully automatic printing line lead particularly to the increased use of suitably adapted transport means for the manual but increasingly automated transport of the sheet pile between a printing press and a transfer station to a further processing machine, such as another printing press or a finishing machine. Sheet-stacking errors due to slipped sheets on the sheet pile can cause considerable consequential errors.

U.S. Pat. No. 4,962,704 discloses a device for protecting the dimensional stability of a pile made up of sheets formed from a web thereof in which they are joined endlessly together, by adhesively securing together the edges of the sheets in the pile at the vertical corners of the pile and in strips located between the corners, adhesive being sprayed or brushed on from a spray bottle or the like continuously from the lowermost to the uppermost sheet of the pile.

Tying together a stack or pile of flat items, such as magazines or newspapers, with ribbon, string or the like having ends which are tied into a bow has become known heretofore from the published German Patent Document DE 38 37 817 A1. Glue application systems, especially spray systems, are also available on the market, as are devices for unrolling wound-up adhesive tapes, or for unrolling adhesive tapes on a wound adhesive-tape carrier.

SUMMARY OF THE INVENTION

It is accordingly an object of the invention to provide a sheet-delivery device in a printing press wherein a sheet pile formed therein is protected against the slipping of predominantly the topmost sheets of the pile, in a most economically possible manner, until the sheets undergo further processing in a further processing machine.

With the foregoing and other objects in view, there is provided, in accordance with the invention, a sheet delivery device in a printing press having stops and sheet pushers or sliders for forming a sheet pile on a changeable sheet-pile carrier, and a conveyor system for transporting sheets successively to a location above the sheet pile, comprising means actuatable, upon the occurrence of a pile change, for stabilizing the sheets forming the sheet pile, the stabilizing means forming a releasable adhesive connection of sheet edges at least at one side of the pile and in an upper region of the pile.

In accordance with another feature of the invention, the stabilizing means for stabilizing the pile of sheets include an applicator for applying an adhesive to edges of the sheets forming the pile.

In accordance with a further feature of the invention, the stabilizing means including the adhesive applicator are disposed on a frame of the printing press and adjustable thereon so as to adapt to different sheet sizes or formats.

In accordance with an added feature of the invention, the stabilizing means including the adhesive applicator are disposed so as to be movable between an operating position and a position of repose.

In accordance with an additional feature of the invention, the adhesive applicator is at least one spray nozzle.

In accordance with an alternative feature of the invention, the adhesive is disposed on a rolled-up adhesive tape, and the adhesive applicator comprises a dispenser and a cutting device for adhesively fastening segments of the adhesive tape to the pile.

In accordance with yet another feature of the invention, the adhesive tape is disposed on a backing tape in a supply roll, and the supply roll is mounted in the dispenser, the dispenser being movably guidable vertically into an operating position at a level of an upper edge of the sheet pile so that a kinked end of an adhesive tape segment is slidable onto an uppermost sheet in the pile, and movably guidable downwardly from the operating position.

In accordance with yet a further feature of the invention, the device includes a vertically movable ram for applying contact pressure to the kinked end of the adhesive tape segment disposed horizontally on the uppermost sheet of the pile, and a vertically movable roller for applying contact pressure to the other end of the adhesive tape segment against edges of the sheets in the pile forming respective sides of the sheet pile.

In accordance with yet an added feature of the invention, mounted on a frame of the printing press, are a dispenser mechanism for an adhesive tape and a contact pressure device for a segment of adhesive tape dispensable and severable from a supply roll by the dispenser mechanism, the dispenser mechanism and the contact pressure device being disposed against the edges of upper sheets in the pile and against an edge of the uppermost sheet in the pile and being movable between an operatively functional position and a position of repose.

In accordance with yet an additional feature of the invention, the sheet stabilizing means are provided at a plurality of sides of the sheet pile.

In accordance with a concomitant feature of the invention, the device includes protective or security elements for blocking actuation of the sheet stabilizing means during sheet delivery.

The means of stabilizing or securing the upper sheets, primarily, of a sheet pile can easily be removed again, does not damage any sheets, and avoids damage to sheets which could be caused by slipping sheets both during transport of a pile and during further processing of the sheets of a pile. Thus, an essential concept of the invention is for at least the sheets in the upper region of the pile to be releasably bound to one another by means of adhesively connecting means when the pile is changed. These means can easily be removed again prior to further processing without having caused sheet damage or, optionally, are formed so that they do not present an obstacle when a sheet is removed upwardly, for example, during sheet separation or singling by lifting suction cups in the delivery of a printing press.

One option for a technical realization of the invention is to apply an adhesive, at least on one side of the pile, to edges of the sheets in the pile, for example, by spraying or brushing it on. The adhesive application can also be performed on more than one side of the pile and can extend over a height required to secure the sheets of the pile against slipping but, optionally, can also extend over virtually the entire height of the pile.

Another arrangement for technically embodying the invention provides a dispenser or unrolling device for a rolled-up adhesive tape, from which the dispenser or unrolling device cuts off segments with a cutter element and presses them adhesively against the pile of sheets.

Preferably, a device should be used by which segments of adhesive tape, disposed on a backing tape in a supply roll, are pressed against the edges of the sheets in the upper region of the pile to secure or stabilize the pile, i.e., maintain the sheets of the pile in alignment, the dispenser or unrolling device forming a kink in the backing tape in a conventional manner at the level of the upper edge of the pile, causing one end of the adhesive tape segment to be pushed onto the uppermost sheet of the pile, and then moving downwardly. Such a device advantageously has means for pressing or brushing the segment of adhesive tape on after the segment has been lifted from the backing tape.

Other features which are considered as characteristic for the invention are set forth in the appended claims.

Although the invention is illustrated and described herein as embodied in a sheet delivery device in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
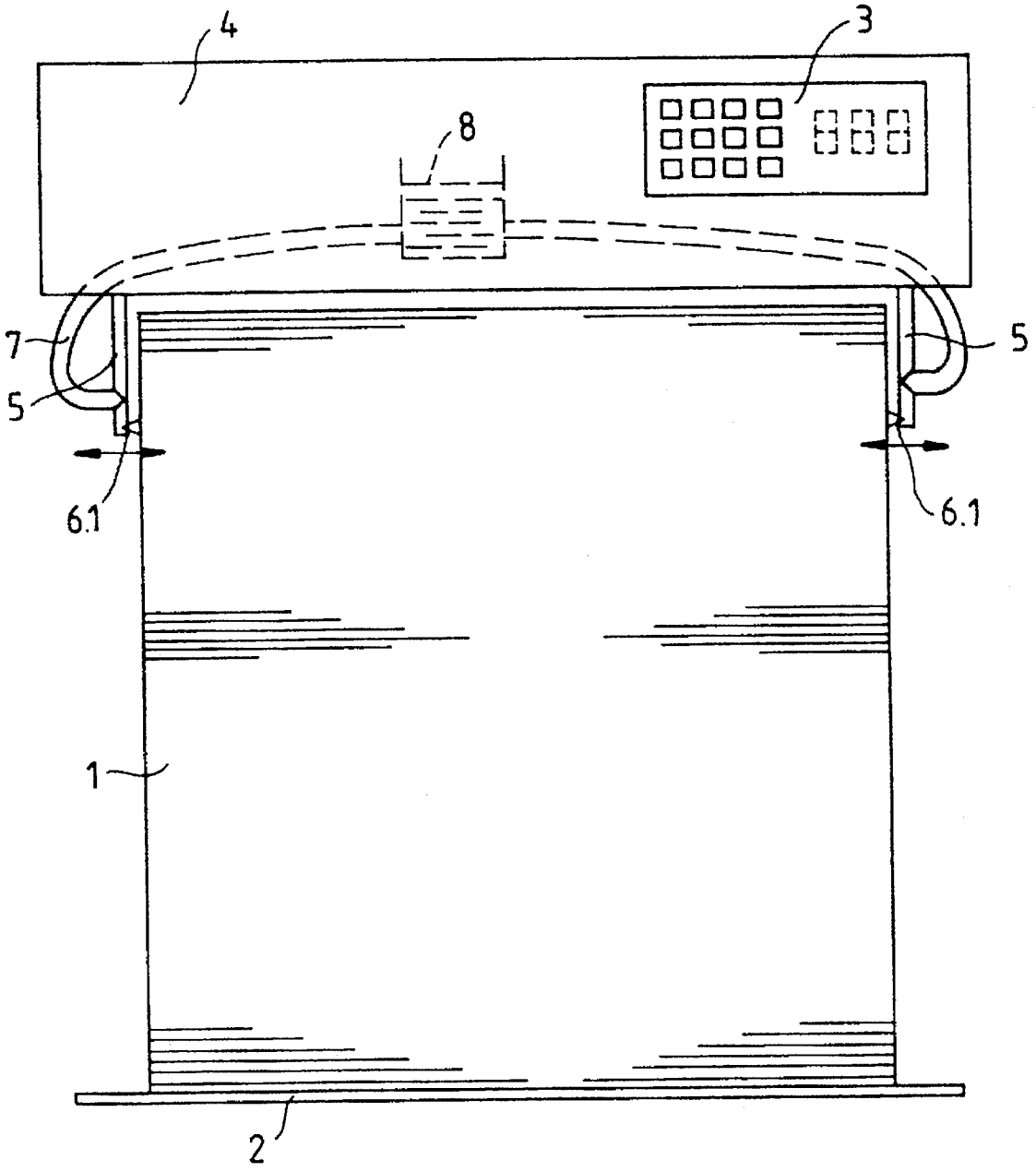
FIG. 1 is a diagrammatic front elevational view of a sheet pile on a pile carrier or support below a control table or console of a sheet delivery.
Figure 2A:
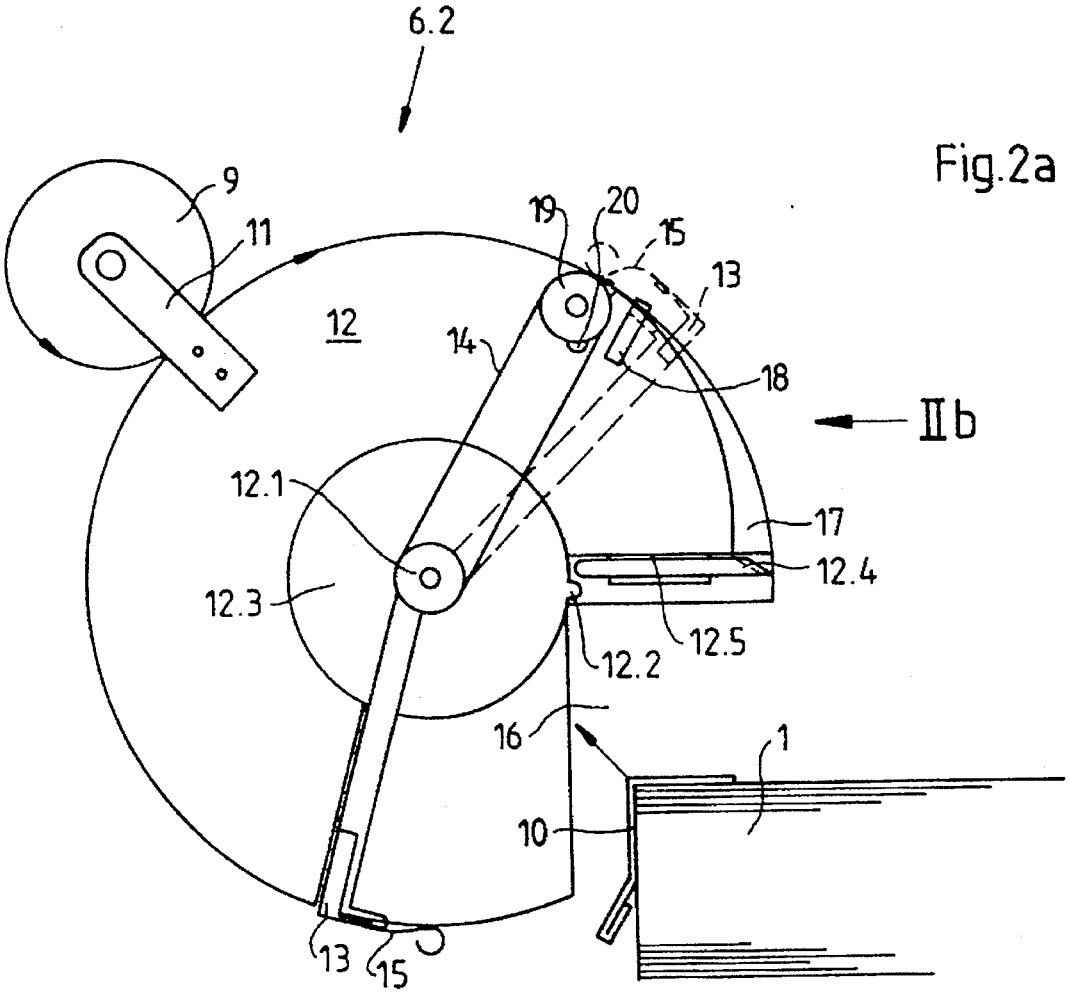
FIG. 2*a* is a diagrammatic side and front perspective view of a dispenser of or unrolling device for adhesive tape segments, shown in association with an upper part of a sheet pile.
Figure 2B:
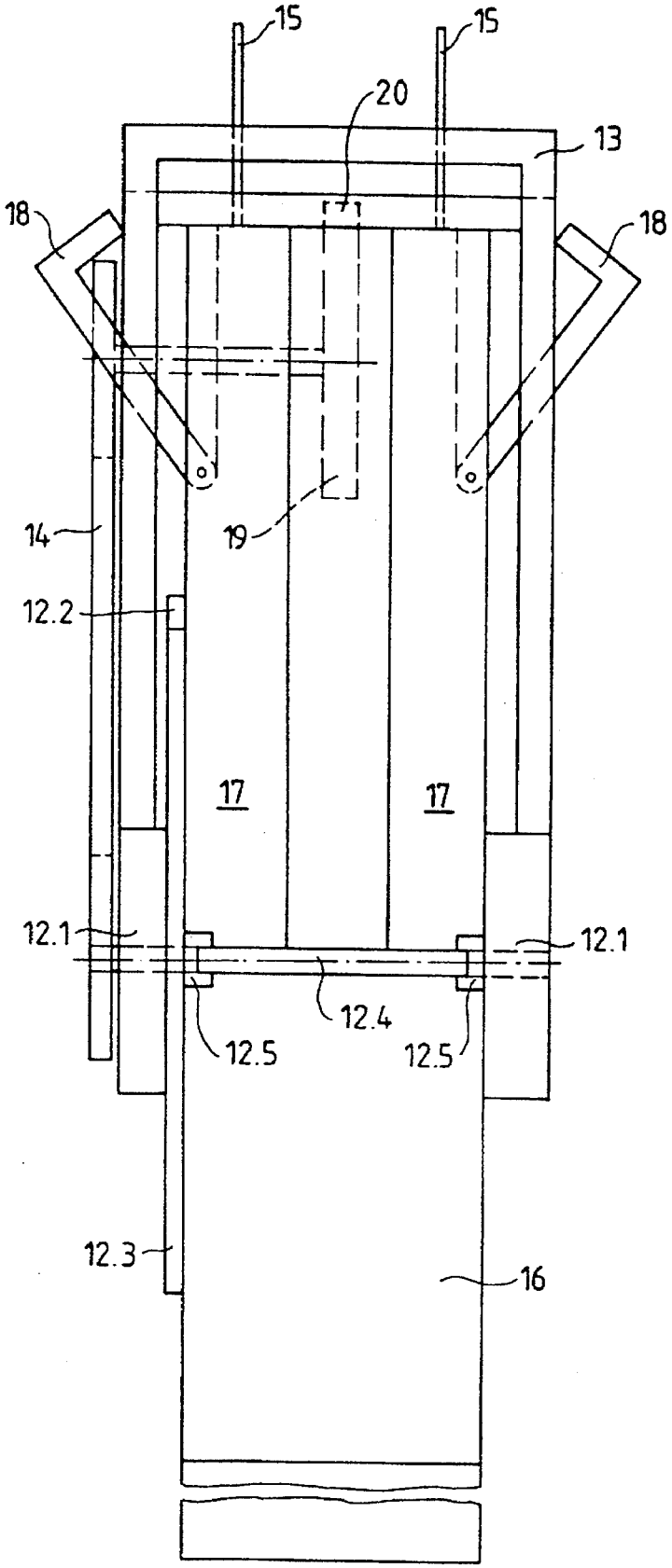
FIG. 2*b* is an enlarged fragmentary view of FIG. 2*a* as seen in the direction of the arrow IIb.

Referring now to the drawings and, first, particularly to FIG. 1 thereof, there is shown therein, in a first embodiment of the invention, a pile of paper 1 formed of individual sheets disposed on an exchangeable pile carrier or holder 2, below a delivery 4, of which only a control table or console 3 is shown. Located laterally next to the pile 1 on the delivery 4 are sheet pushers or sliders 5, which are driven with reciprocating motion against the side of the pile and which extend downwardly across an upper region of the sheet pile 1, so that, due to the movement of the sheet pushers 5, sheet alignment and exact formation or development of the pile result. Disposed in lower ends of the sheet pushers 5, as viewed in FIG. 1, are spray nozzles 6.1, brush elements or the like for applying a gluelike adhesive to the edges of the sheets opposite the nozzles 6.1 or the like, in an upper region of the sheet pile 1. These spray nozzles 6.1 are supplied via a line 7 with a gluelike adhesive from a supply container 8. By means of the spray nozzles 6.1 or the like, prior to a pile change, a fine film of glue or adhesive or the like can be applied, with a vertical relative motion between the sheet pile 1 on the pile carrier 2 and the spray nozzles 6.1. One advantage of this arrangement is that the adaptation of the spray nozzles to different sheet pile sizes or formats can be effected automatically by suitably changing or converting the setting of the sheet pushers 5 to accommodate the different paper-sheet sizes or formats. The components required to spray an adhesive film are space-saving and, in practical operation, are no hindrance to the sheet delivery device. The use of the device takes place briefly when a pile change occurs, and can be placed in operation even shortly before the optional pile height is reached. In the arrangement of FIGS. 2*a* and 2*b*, pile securing or sheet alignment-maintaining means are provided by applying segments of an adhesive tape 10 held ready on a supply roll 9 of a dispenser or unrolling device generally identified by reference character 6.2. The supply roll 9 is secured by means of a holder 11 to the circumference of a movably supported dispenser or unrolling cylinder 12, along the circumference of which a gripper device 13 runs. A rotatable support 12.1 of the gripper device 13 is located in the center of the dispenser or unrolling device 12. A cam 12.2 mounted on a rotatably supported disk 12.3 serves for controlling the gripper device 13. During the swiveling movement of the dispenser or unrolling cylinder 12, the gripper device 13 engages the end of the tape that is held against the circumference of the dispenser cylinder by a spring clip 15, so that, during the swiveling movement from one position to another, a segment of adhesive tape of corresponding length is pulled from the supply roll 9 and held taut over an approximately rectangular recess or cutout 16 formed in the dispenser or unrolling cylinder 12. Due to a movement of the dispenser or unrolling device 12 towards the corner of the pile of sheets, this adhesive tape segment is pressed against the pile, around the upper corner thereof. After this contact pressure has been adequately applied, the cam 12.2 moves a cutting blade 12.4, which is reciprocably displaceable horizontally in a bearing support 12.5. The adhesive strip 10 pressed against the edge of the pile is thereby severed from the adhesive tape on the supply roll 9. The dispenser or unrolling device 12 then returns to its starting position, leaving the adhesive tape segment or strip 10 behind on the upper corner of the sheet pile 1. The pile change can then be performed.

As an added and alternative feature of the invention, the improved embodiment of the dispenser or unrolling device 6.2 shown in FIG. 2*a* provides for the spring clip 15, during the swiveling movement, to travel along a curved path 17 which is drawn radially inwardly in comparison with the otherwise circular circumferential path thereof, so that, during the swiveling movement, the spring clip 15 can dip into the cutout or recess formed by the cam path. In this regard, the end of the adhesive tape from the supply roll 9 wraps around retaining clamps 18, so that two adhesive sides face one another and are thus disposed on one another, and an adhesive-free location is formed. After this movement, the remaining clamps 18 move apart. Due to the rotary motion of the gripper device 13, a wheel 19 on which a cam 20 is located, is moved by a belt 14. By means of this cam 20, the wrapped-around end of the adhesive tape is pressed upwardly, so that it can be engaged by the opened gripper device and entrained thereby. The gripper device 13 then moves to the position thereof shown in solid lines, so that a new adhesive bonding operation can be initiated. The arrangement of such a dispenser or unrolling device according to the exemplary embodiment of FIG. 2*a* is preferably provided so that it is adjustable in accordance with the sheet size or format. The dispenser or unrolling device is preferably in a retracted position of repose during the formation of the pile, and is displaceable from this position of repose into an operating position for the purpose of providing the pile securing or sheet alignment-retaining means.

Figure 3A:
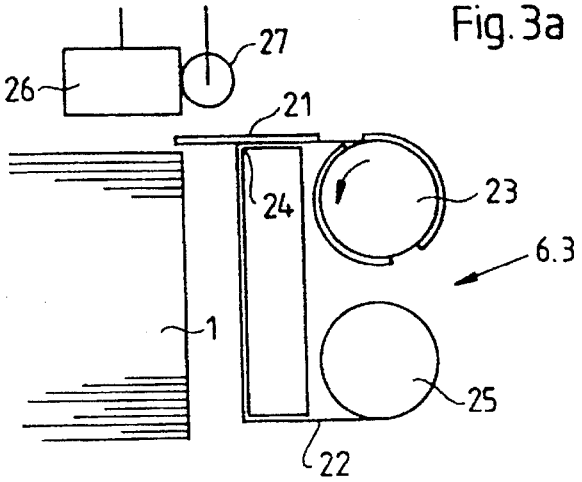
FIGS. 3*a* to 3*d* are respective diagrammatic side elevational views, much reduced from the view of FIG. 2*a*, of a dispenser or unrolling device and a pressure-applying device for an adhesive tape carrier or backing unrolling from a supply roll, in various operating positions thereof.
Figure 3B:
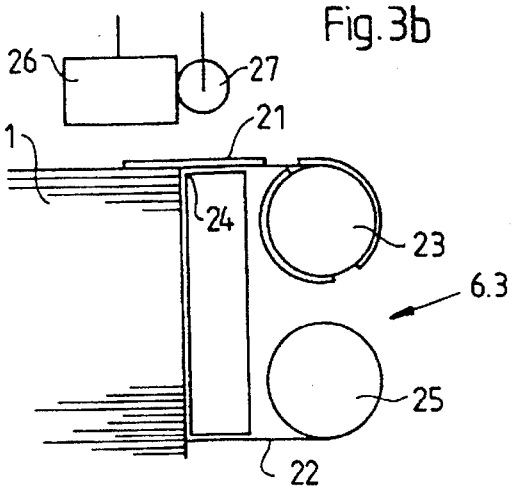
Figure 3C:
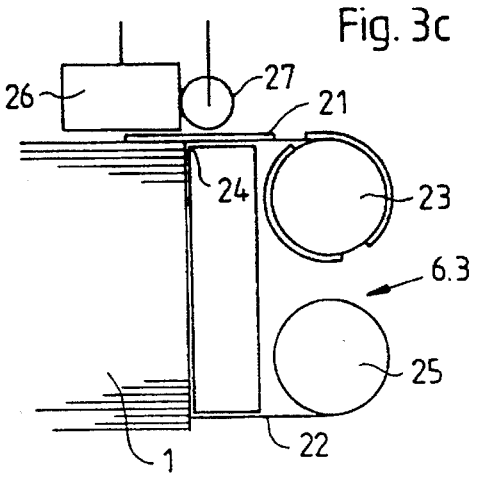
Figure 3D:
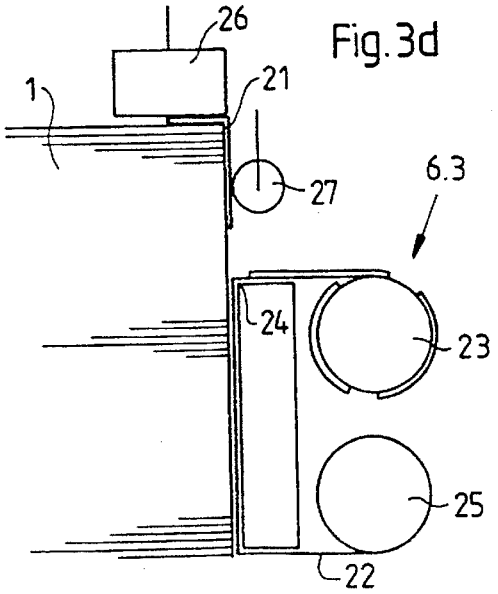

FIGS. 3*a* to 3*d* diagrammatically show a dispenser or unrolling device, generally identified by reference character 6.3, for adhesive tape segments 21 which are disposed on a wound-up backing or carrier tape 22. The backing tape 22 is wound up on a supply roll 23 and is deflected, at the level of the top sheet in the pile, by a stripper edge 24, before being wound onto a storage roll 25. Located above the pile 1 and in the vicinity of a side thereof is a ram or piston 26, which is movable up and down, and a contact pressure roller 27, which is likewise movable up and down. The dispenser or unrolling device is positionable against one side of the pile and is movable back from the resultant operating position thereof into the starting position shown in FIG. 3*a* and beyond that to a position of repose, respectively. For applying a segment 21 of adhesive tape serving as pile securing means, the dispensing or unrolling device is suitably moved until it contacts the side of the pile 1, the stripper edge 24 then being located at the level of the top sheet in the pile 1, so that one end of the adhesive tape segment 21 is pushed forward over the edge of the pile. This end of the adhesive tape segment 21 is released from the backing tape 22 by the movement of the backing tape 22 over the stripper edge 24. In the position shown in FIG. 3*b*, the contact pressure ram or piston 26 and the contact pressure roller 27 move downwardly until they touch the adhesive tape segment 21, and the contact pressure ram 26 presses the end 21 of the adhesive tape adhesively against the top sheet, as shown in FIG. 3*c*. From this position, the dispenser or unrolling device together with the contact pressure roller 27 moves downwardly, the unwinding forward feed of the backing tape 22 from the supply roll 23 having already ceased. The adhesive tape segment 21 is peeled off the backing tape 22 by this motion and is stuck at its other end to the sheet edges on the side of the pile. Thereafter, the dispenser or unrolling device, the contact pressure ram or piston 26 and the contact pressure roller 27 return to the starting position thereof. When a new operation or working cycle is begun for applying means for securing or maintaining the integrity of the pile, the unwinding forward feed of the backing tape 22 is initially turned on, until an adhesive tape segment 21 has been pulled approximately halfway over the stripper edge 24 and been peeled off the backing tape 22 to an extent such as can be seen in FIG. 3*a*. This type of dispenser or unrolling device, which is likewise preferably adjustable in accordance with the sheet size or format, is arranged in a delivery of a printing press or the like, and is, moreover, disposed movably between a retracted position of repose and an approach position for the startup of the operation.

Devices in accordance with the constructions shown in FIGS. 1 to 3 may be disposed either on only one side of a pile in the delivery of a printing press, on two opposing sides of a pile, or on a plurality of sides of a pile. The actuation of the devices for applying a pile securing means can be performed in a relatively simple manner by manual shifting or switching but preferably also by an electronic process control, in order to avoid shifting or switching errors and to accelerate the process of securing a pile. It is also advantageous, by means of conventional safety or protective elements, to block the actuation of the device which applies the pile securing means during the operation of the sheet delivery.

I claim:

1. Sheet delivery device in a printing press having stops and sheet pushers or sliders for forming a sheet pile on a changeable sheet-pile carrier, and a conveyor system for transporting sheets successively to a location above the sheet pile, comprising means actuatable, upon the occurrence of a pile change, for stabilizing the sheets forming the sheet pile, said stabilizing means forming a temporary releasable adhesive connection of sheet edges at least at one side of the pile and only in an upper region of the pile.

2. Device according to claim 1, wherein said stabilizing means for stabilizing the pile of sheets include an applicator for applying an adhesive to edges of the sheets forming the pile.

3. Device according to claim 2, wherein said stabilizing means including said adhesive applicator are disposed on a frame of the printing press and adjustable thereon so as to adapt to different sheet sizes or formats.

4. Device according to claim 3, wherein said stabilizing means including said adhesive applicator are disposed so as to be movable between an operating position and a position of repose.

5. Device according to claim 2, wherein said adhesive applicator is at least one spray nozzle.

6. Sheet delivery device in a printing press having stops and sheet pushers or sliders for forming a sheet pile on a changeable sheet-pile carrier, and a conveyor system for transporting sheets successively to a location above the sheet pile, comprising means actuatable, upon the occurrence of a pile change, for stabilizing the sheets forming the sheet pile, said stabilizing means forming a releasable adhesive connection of sheet edges at least at one side of the pile and in an upper region of the pile, wherein said stabilizing means for stabilizing the pile of sheets include an applicator for applying an adhesive to edges of the sheets forming the pile, wherein said adhesive is disposed on a rolled-up adhesive tape, and said adhesive applicator comprises a dispenser and a cutting device for adhesively fastening segments of the adhesive tape to the pile.

7. Device according to claim 6, wherein the adhesive tape is disposed on a backing tape in a supply roll, and the supply roll is mounted in said dispenser, said dispenser being movably guidable vertically into an operating position at a level of an upper edge of the sheet pile so that a kinked end of an adhesive tape segment is slidable onto an uppermost sheet in the pile, and movably guidable downwardly from said operating position.

8. Device according to claim 7, including a vertically movable ram for applying contact pressure to said kinked end of said adhesive tape segment disposed horizontally on the uppermost sheet of the pile, and a vertically movable roller for applying contact pressure to the other end of the adhesive tape segment against edges of the sheets in the pile forming respective sides of the sheet pile.

9. Sheet delivery device in a printing press having stops and sheet pushers or sliders for forming a sheet pile on a changeable sheet-pile carrier, and a conveyor system for transporting sheets successively to a location above the sheet pile, comprising means actuatable, upon the occurrence of a pile change, for stabilizing the sheets forming the sheet pile, said stabilizing means forming a releasable adhesive connection of sheet edges at least at one side of the pile and in an upper region of the pile, wherein, mounted on a frame of the printing press, are a dispenser mechanism for an adhesive tape and a contact pressure device for a segment of adhesive tape dispensable and severable from a supply roll by the dispenser mechanism, said dispenser mechanism and said contact pressure device being disposed against the edges of upper sheets in the pile and against an edge of the uppermost sheet in the pile and being movable between an operatively functional position and a position of repose.

10. Device according to claim 1, wherein said sheet stabilizing means are provided at a plurality of sides of the sheet pile.

* * * * *